United States Patent [19]

Michaels et al.

[11] Patent Number: 4,869,686

[45] Date of Patent: Sep. 26, 1989

[54] RIGHT ANGLE ELECTRICAL CONNECTOR

[75] Inventors: Leonard H. Michaels, Warrenville; Robert A. Miller, Woodbridge, both of Ill.

[73] Assignee: Molex Incorporated, Lisle, Ill.

[21] Appl. No.: 175,015

[22] Filed: Mar. 30, 1988

[51] Int. Cl.[4] ..... H01R 13/58

[52] U.S. Cl. ..... 439/455; 439/457; 439/468

[58] Field of Search ..... 439/449, 452, 453, 455–457, 439/459, 460, 465–468, 470, 472, 473

[56] References Cited

U.S. PATENT DOCUMENTS

| | | | |
|---|---|---|---|
| 1,752,585 | 4/1930 | Beardsley et al. | 439/455 |
| 2,171,331 | 8/1939 | Folsom, Jr. | 439/455 |
| 2,216,157 | 10/1940 | Charmoy | 439/455 |
| 2,236,764 | 4/1941 | Peterson | 439/455 |
| 4,758,174 | 7/1988 | Michaels et al. | 439/281 |

*Primary Examiner*—Gary F. Paumen

*Attorney, Agent, or Firm*—John W. Cornell; Louis A. Hecht

[57] ABSTRACT

An electrical connector housing and an electrical connector are provided. The housing comprises telescopingly engageable first and second shells, each of which includes a generally peripheral side wall and opposed ends. The first shell is characterized by a cutout portion extending through the peripheral side wall from the one end thereof to a location intermediate the opposed ends. The second shell includes an aperture extending through the peripheral side wall at a location intermediate the opposed ends. A generally tubular eyelet is dimensioned to be slidably disposed over a cable and to be slidably inserted into the aperture in the second shell, with the axes of the eyelet and the cable being angularly aligned to the central axis of the second shell. The telescoping engagement of the first and second shells causes the cutout portion of the first shell to crimp the eyelet into secure engagement with both the cable and the aperture of the second shell.

20 Claims, 2 Drawing Sheets

RIGHT ANGLE ELECTRICAL CONNECTOR

BACKGROUND OF THE INVENTION

Many electrical connectors enable the conductors of a cable to be electrically joined to terminals in the connector. The connector with the cable extending therefrom can be mated with a compatible connector which is mounted to another cable, an electrical apparatus or the like. Electrical connectors desirably should achieve many objectives including: a high quality electrical connection; low manufacturing costs; a minimum number of components; a low design profile; easy assembly; environmental sealing; compatibility with other connectors and durability.

One very desirable electrical connector that achieves the above identified objectives is shown in patent application Ser. No. 005,045 entitled "ENVIRONMENTALLY SEALED ELECTRICAL CONNECTOR", now U.S. Pat. No. 4,758,174, which was filed by Leonard H. Michaels and which is assigned to the assignee of the subject invention. The disclosure of this co-pending application is incorporated herein by reference.

As explained in application Ser. No. 005,045, it is often necessary or desirable to have the cable extend from the connector at approximately 90° to the mating axis of the connector. However, the mere uncontrolled bending of a cable through 90° immediately adjacent to a connector can create stresses within the cable or at the electrical and mechanical connections between the cable conductors and the terminals of the connector. The stresses created at these locations by the uncontrolled bending of the cable has been known to cause sufficient stress to damage the conductors and render the connector substantially inoperative.

One type of structure intended to avoid these problems is a plastic right angle head molded directly onto the assembled connector. Although this prior art structure is compact, it is also costly and suffers from poor reliability. In particular, the insert molding process required for these right angle heads is time consuming and labor intensive. Additionally, these right angle heads employ elastomers as the insulation material to bond to and seal the cable under flexing. However, these elastomers contribute to two other failure modes. For example, the elastomer stresses under tension and becomes proportionally thinner. As a result, it is possible to break the wires under the elastomer at the crimp joint in the right angle head. Damage of this type cannot be seen on the outside of the part, and will only be realized by a failure of the connector in testing or actual use. It also has been found that the bonding of the elastomer to the cable is unpredictable and appears to vary in accordance with unpredictable molding process parameters. In many instances, the elastomer will fail to seal and/or bond to the cable. Consequently, the cable will slip relative to the elastomer, and the intended strain relief will not be provided.

Another distinct structure for providing right angle connectors is to employ cast metal angles or multiple cast parts to obtain the required angular orientation. These designs generally work well and do not suffer from the failures described above with respect to the molded on right angle heads. However, connectors employing multiple cast parts are extremely expensive to manufacture and are much larger. Size often is one of the most important design criteria of the connector.

Still another structure for obtaining the right angle orientation of the connector is to employ multiple metallic parts that are brazed together. Once again, the resulting parts are reliable, but they are costly and labor intensive to manufacture, and are undesirably large.

The above described U.S. patent application Ser. No. 005,045 shows and describes a right angle adapter that is molded from an elastomeric material. This adapter is desirable in that it can readily be added on after the cable and connector half are in a fully assembled condition. Although this right angle adapter offers certain advantages, it is desirable to provide a right angle connector that reliably provides more positive strain relief and that securely grips the cable in an unstressed condition.

In view of the above, it is an object of the subject invention to provide an electrical connector with a cable exit at an angle to the mating axis of the connector.

It is another object of the subject invention to provide an efficient electrical connector with a cable exit at 90° to the mating axis of the connector.

It is a further object of the subject invention to provide an electrical connector with a right angle cable exit and that is simple in construction, and easy to assemble.

It is still another object of the subject invention to provide an electrical connector with a right angle cable exit wherein the connector provides a seal and strain relief to the cable interface.

A further object of the subject invention is to provide an efficient electrical connector with a right angle cable exit and with a compact design profile.

SUMMARY OF THE INVENTION

The subject invention is directed to a right angle connector plug or socket that can be manufactured inexpensively, assembled easily from a small number of components, while still providing environmental sealing, a low design profile and desirable strain relief.

The connector comprises a substantially rigid housing having first and second telescopingly engageable shells. Each shell comprises opposed first and second ends and a generally tubular peripheral side wall extending therebetween. The first shell comprises a cable crimping cutout portion extending through the peripheral side wall adjacent one end thereof. The second shell includes a cable receiving aperture extending through the peripheral side wall intermediate the opposed ends. Alternatively, the second shell may include a flared entry semi-elliptical cutout or slot in the peripheral side wall extending inwardly from an end to a point intermediate the opposed ends.

The first or second shell is dimensioned and configured to receive at least one terminal connectable to a conductor of a cable. The cable extends from the terminal and through the aperture or cutout in the peripheral side wall of the second shell. The telescoping engagement of the shells will cause the cable crimping cutout portion of the first shell to positively retain the cable at the aperture or cutout in the second shell.

As explained further below, the connector housing may further comprise a crimpable eyelet disposed over the cable and extending through the aperture or cutout in the second shell. The telescoping engagement of the shells will cause the cutout portion of the first shell to crimp the eyelet. The deformed eyelet will positively engage both the cable and the second shell adjacent the aperture therethrough.

The connector may comprise a dielectric insert for supporting the terminals of the connector. The dielectric insert may be of unitary construction and may be molded from an elastomeric material having a high coefficient of friction, such as the polyester elastomers described and identified in application Ser. No. 005,045. The terminals mountable in the insert are mechanically and electrically connected to the conductors of the cable.

In one embodiment, the connector comprises a rigid first shell with opposed forward and rear ends. The first shell preferably is formed from a metallic material such as brass. The forward end of the first shell has its interior dimensioned and configured to receive at least a portion of the dielectric insert. In a preferred embodiment, as explained further below, the forward end of the first shell is dimensioned to frictionally retain the elastomeric insert therein.

A coupling nut may be mounted over the forward end of the first shell and suitably retained thereon. For example, a portion of the forward end of the first shell may be flared outwardly to engage a portion of the coupling nut and to permit relative rotation therebetween.

The rear end of the first shell also is of generally tubular configuration, and may be substantially cylindrical. However, a peripheral portion of the rear end of the first shell includes the above described cutout portion. The cutout portion of the rear end of the first shell may be arcuate in configuration.

The second shell may have an opened forward portion and a closed rear end. The forward portion of the second shell may have a size and configuration that enables the second shell to be telescopingly engaged with the rear end of the first shell and to be tightly retained in the assembled condition. The second shell is further defined by an aperture extending through a peripheral wall intermediate the opposed front and rear ends thereof.

As noted above, the connector may further comprise an eyelet of generally tubular configuration and having an internal dimension to enable the eyelet to be tightly received over the cable. The external dimension of the eyelet enables the eyelet with the cable mounted therein to be inserted through the aperture in the peripheral side wall of the second shell. Additionally, the external dimensions of the eyelet and the dimensions of the cutout portion in the first shell are selected to enable the cutout portion to engage and at least partly surround the eyelet.

The connector of the subject invention may be assembled by electrically and mechanically connecting the conductors of the cable to the respective terminals. The terminals in turn may be engaged in the apertures of the dielectric insert. The coupling nut may be engaged with the forward end of the first shell and the cable may be urged longitudinally through the first shell such that the insert with the terminals therein is securely engaged within the first shell. The cable also may be directed through the aperture in the second shell and through the eyelet. It is to be understood, however, that the particular order of the above identified assembly steps may vary considerably depending upon the particular application for the connector and depending upon the specific construction for the terminals, the dielectric insert, the forward end of the first shell and such.

The assembly of the connector may be completed by advancing the eyelet and the assembled first shell toward one another with the second shell therebetween. More particularly, the eyelet with the cable directed therethrough may be urged into the peripheral side wall aperture in the second shell, while the second shell is urged into telescoping engagement with the first shell. Sufficient movement of the second shell toward the rear end of the first shell will cause the cutout portion of the first shell to surround and engage at least a portion of the eyelet extending through the peripheral aperture in the second shell. Continued relative movement of the first and second shells toward one another will cause the cutout portion of the first shell to crimp and deform the eyelet. This deformation of the eyelet causes the eyelet to securely engage and seal itself around the cable. Furthermore, the deformation of the eyelet causes dimensional changes in the eyelet which result in the eyelet being securely engaged within the peripheral side wall aperture of the second shell. This secure engagement of the eyelet to both the outer insulation of the cable and to the second shell provides the necessary strain relief that prevents damage to the conductors of the cable. Additionally, the components of the connector can be easily manufactured and assembled at low cost. Furthermore, the assembled connector provides a low profile and achieves the desirable environmental sealing both by virtue of the crimped eyelet engaging the cable and engaged by the first and second shells, and by virtue of the dielectric insert that may be inserted into the first shell.

In the alternate embodiment mentioned above, the second shell may be provided with a flared entry arcuate cutout or slot adjacent its forward end rather than an aperture between the two ends as described above. The arcuate cutout or slot in the forward end of the second shell is dimensionally to securely engage the cable and/or the eyelet through which the cable extends. In this embodiment the cable and/or eyelet are securely engaged intermediate the cutouts in the first and second shells.

DETAILED DESCRIPTION OF THE PREFERRED EMBODIMENT

Figure 1:
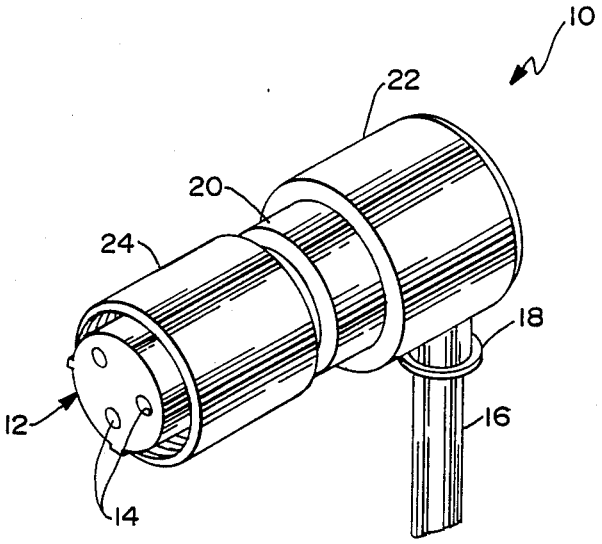
FIG. 1 is a perspective view of the assembled connector in accordance with the subject invention.

The connector of the subject invention is illustrated in FIG. 1, and is identified generally by the numeral 10. The connector 10 includes a dielectric insert 12 at its mating end to enable the connector 10 to be matably joined with a corresponding connector. The dielectric insert 12 includes a plurality of apertures 14 in which terminals (not shown) are securely mounted. Although the connector 10 is depicted as being the female half of a connector assembly, it is to be understood that the structure disclosed herein can be incorporated into a connector having male terminals.

The connector 10 is engageable with a cable 16 having a plurality of conductors (not shown) therein. The connector 10 is constructed, as explained in detail below, to enable the axis of the cable 16 extending from the connector 10 to be aligned substantially at a right angle to the longitudinal or mating axis defined by the insert 12 and the terminals mounted therein.

The connector 10, as shown generally in FIG. 1, comprises an eyelet 18, a first shell 20 and a second shell 22. The eyelet 18 securely surrounds and engages the cable 16, and extends into and securely engages the second shell 22 of the connector 10. The specific construction which enables the eyelet 18 to securely engage both the cable 16 and the second shell 22 is described in greater detail below.

The connector 10 further comprises a first shell 20 which is of generally tubular construction and is securely telescopingly engaged in the second shell 22. The first shell 20 is generally tubular, and includes a central opening into which the dielectric insert 12 is inserted and retained. A coupling nut 24 is mounted to the forward end of the first shell 20 to permit relative rotation therebetween. The inner surface of the coupling nut 24 is characterized by an array of internal threads which enable the connector 10 to be securely mechanically joined to another component (not shown).

Figure 2A:
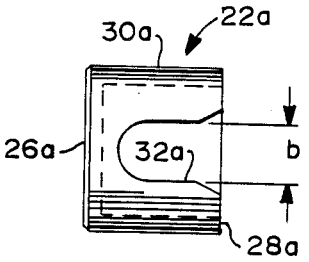
FIG. 2A is a bottom plan view of an alternate embodiment of the second shell shown in FIG. 2.
Figure 2:
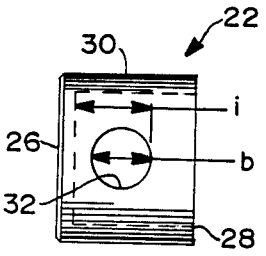
FIG. 2 is a bottom plan view of the second shell of the connector.
Figure 3:
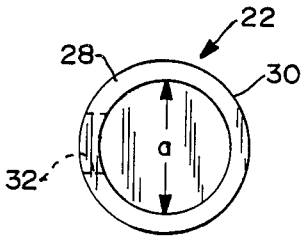
FIG. 3 is a side elevational view of the second shell shown in FIG. 2.

The second shell 22 of the connector 10 is shown in greater detail in FIGS. 2 and 3. The second shell 22 is of generally cylindrical construction with a closed rear end 26 and an open forward end 28 such that a generally cylindrical cavity having an internal diameter "a" extends into the forward end 28. A generally cylindrical peripheral side wall 30 extends between the opposed rear and forward ends 26 and 28, and is characterized by a generally cylindrical peripheral aperture 32 extending entirely therethrough intermediate the opposed ends 26 and 28. The aperture 32 has a diameter indicated by dimension "b" in FIG. 2.

FIG. 2A shows an alternate second shell **22*a* which has a closed rear end 26*a*, an open forward end 28*a* and a cylindrical side wall 30*a*, all of which are dimensionally identical to corresponding parts of the second shell 22 shown in FIGS. 2 and 3. The second shell 22*a*, however, includes a flared-entry arcuate cutout 32*a* extending through the peripheral side wall 30*a* from the forward end 28*a* to a location intermediate the opposed ends 26*a* and 28*a***.

Figure 5:
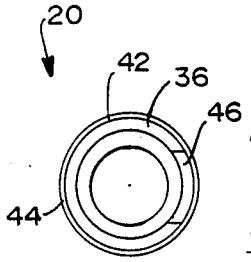
FIG. 5 is a side elevational view of the first shell as viewed from the left side of FIG. 4.
Figure 4:
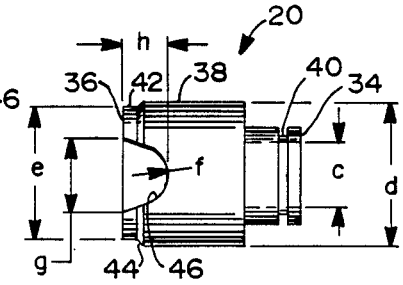
FIG. 4 is a bottom plan view of the first shell of the subject connector.

The first shell 20 is illustrated in FIGS. 4 and 5 and is of generally tubular construction with opposed forward and rear opened ends 34 and 36 respectively. A cylindrical peripheral side wall 38 extends between the opposed forward and rear ends 34 and 36. A generally annular groove 40 extends into the exterior surface of the first shell 20 in proximity to the forward end 34. The inwardly extending annular groove 40 enables the forward end 34 to be readily and precisely flared outwardly, thereby enabling the coupling nut 24 to be rotatably mounted thereon. The forward end 34 of the first shell 20 defines an internal diameter "c" as shown in FIG. 4 which enables the dielectric insert 12 to be slidably inserted therein and frictionally retained in position. As noted above, the dielectric insert 12 to be employed with the subject connector 10 preferably is formed from a polyester elastomer having a high coefficient of friction to enable a secure and environmentally sealed engagement between the first shell 20 and the insert 12. As noted in the application Ser. No. 005,045, the insert 12 may be molded from a HYTREL polyester elastomer having a SHORE A Durometer hardness of 90 coupled with the high coefficient of friction. Although not shown, the first shell 20 and the insert 12 may comprise compatible arrays of keys and keyways to achieve a selected angular orientation of the terminals therein.

The first shell 20 defines a major external diameter "d" which is slightly greater than the internal diameter "a" of the second shell 22. For example, the internal diameter "a" of the second shell 22 may be in the range 0.4885–0.4900 inch, while the major external diameter "d" of the first shell 20 may be in the range of 0.4910–0.4925 inch. As a result, a force fit engagement is achieved when the major diameter portion of the first shell 20 is urged into the forward end 28 of the second shell 22. The first shell 20 is provided with a reduced diameter portion adjacent the extreme rear end 36 to facilitate the initial insertion of the first shell 20 into the slightly smaller second shell 22. In particular, a minor external diameter portion 42 is defined immediately adjacent the rear end 36 with a diameter "e" which is less than the internal diameter "a" of the second shell 22. A generally conical tapered portion 44 extends between the portions of the first shell 20 defining the minor and major diameter portions thereof.

The first shell 20 further comprises a generally arcuate cutout 46 extending through the cylindrical side wall 38 from the rear end 36 thereof. The cutout portion 46 preferably defines a radius "f" which may be 0.105 inch, but which preferably converges into a wider opening as indicated by dimension "g" at the extreme rear end 36. For example, the dimension "g" may be approximately 0.270 inch. The overall depth of the cutout 46, as measured from the rear end 36 and as indicated by dimension "h" in FIG. 4 is less than or equal to the distance "i" between the rear wall 26 and the front of aperture 32 of the second shell 22 as shown in FIG. 2.

Figure 6:
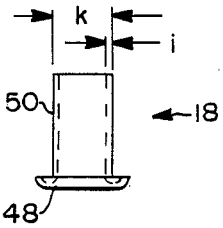
FIG. 6 is a front elevational view of the eyelet of the subject connector.

The crimpable eyelet 18 is shown in greater detail in FIG. 6. In particular, the eyelet 18 comprises an enlarged flange 48 adjacent one end and a generally cylindrical portion 50 extending therefrom. The eyelet 18 is hollow with an internal diameter permitting the cable 16 to be slid tightly therethrough. Furthermore, the generally cylindrical portion 50 of the eyelet 18 has a thin crimpable side wall thickness "j" of approximately 0.011 inch. The overall external diameter "k" of the cylindrical portion 50 of eyelet 18 is less than the maximum dimension "g" of the cutout portion 46 on the first shell 20. However, the external diameter "k" of the eyelet 18 preferably is greater than twice the radius "j" defined by the base of the cutout portion 46 on the first shell 20. For example, on embodiments where the radius "j" of the cutout portion on the first shell 20 equals approximately 0.105 inch, the external diameter "k" of cylindrical portion 50 on the eyelet 18 will equal approximately 0.215 inch. As a result of these relative dimensions, the thin walled cylindrical portion 50 of the crimpable eyelet 18 can only be fully seated in the cutout portion 46 of the first shell 20 by deformation of the eyelet 18. The relatively small thickness "j" of the cylindrical walls of eyelet 18 facilitates this deformation.

Figure 7:
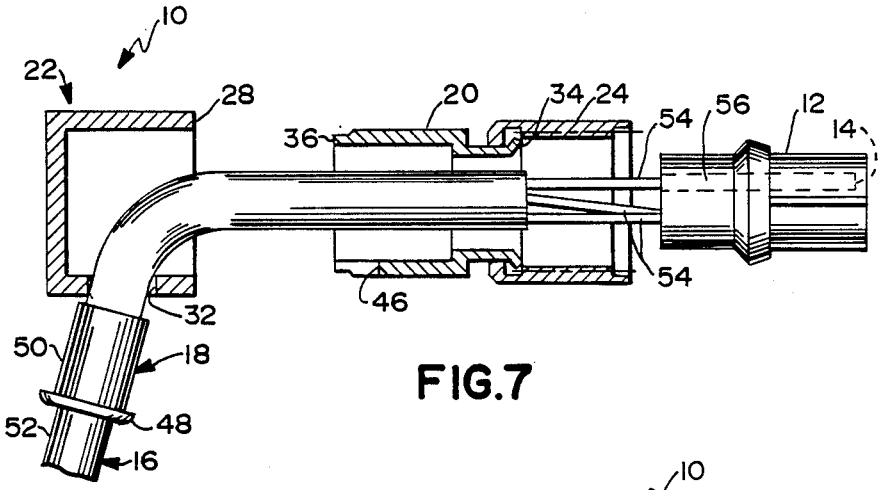
FIG. 7 is an exploded cross-sectional view of the connector at a stage during its assembly.
Figure 8:
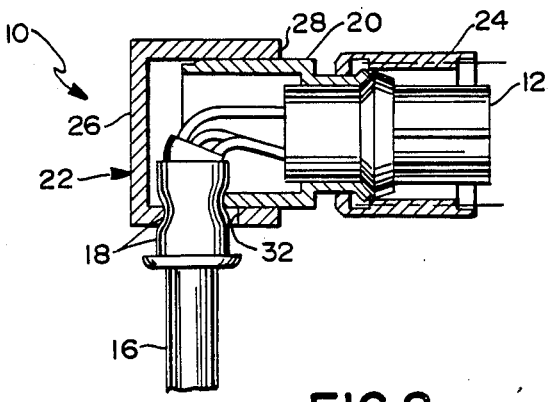
FIG. 8 is a cross-sectional view of the assembled connector.
Figure 9:
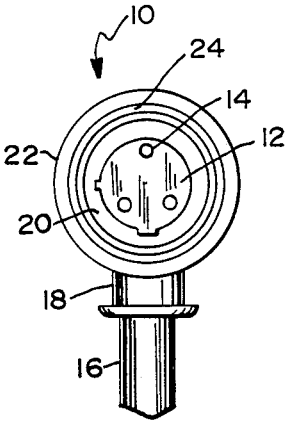
FIG. 9 is a side elevational view of the connector as viewed from the right side shown in FIG. 8.

The connector 10 of the subject invention is assembled as shown in FIGS. 7–9. As noted above, the assembly steps described herein may be varied from one application to the next, as will be appreciated by the person skilled in this art. Typically, the first step in the assembly process is to slide the coupling nut 24 over the forward end 34 of the first shell 20. The extreme front end 34 will then be flared outwardly to retain the coupling nut 24 on the first shell 20, but to permit relative rotation and controlled axial movement therebetween. The cable 16 is then directed through the end of the eyelet 18 having the flange 48 thereon, and is further directed through the aperture 32 in the second shell 22 such that the cable may continue out the opened forward end 28 of the second shell 22. In embodiments employing a second shell **22*a*, with the cutout 32*a*, it is merely necessary to align the cable 16 and eyelet 18 with the cutout 32*a*. The cable 16 is further directed through the rear and 36 of the first shell 20 and through the coupling nut 24. The external insulation 52 of the cable 16 may then be stripped away for a selected distance to expose the insulated conductors 54 thereof. The insulation on the individual conductors 54 may be suitably exposed to enable the conductors to be electrically and mechanically joined to the terminals 56 which in turn are mounted in the apertures 14 of the dielectric insert 12**.

The insert 12 with the conductors 54 and the terminals 56 therein is urged into frictional engagement within the first shell 20 to define a subassembly. The first shell 20 is then urged toward the second shell 22, while the cable 16 is continually urged through the eyelet 18 and the aperture 32 in the second shell 22. In embodiments employing the second wall **22*a*, the cable is merely moved longitudinally relative to the cutout 32*a*. Continued movement of these components toward one another will cause the first shell 20 to be force fit into the second shell 22 or 22*a*, and will further urge the eyelet 18 into the aperture 32 of the second shell 22 or the cutout 32*a* of the alternate second shell 22*a*. The first shell 20 is rotationally aligned about its axis and relative to the second shell 22 or 22*a* such that the cutout 46 of the first shell 20 is aligned with the aperture 32 in the second shell 22 or the cutout 32*a* in the alternate second shell 22*a*. Continued advancement of the first shell 20 toward the second shell 22 or 22*a* will result in a tight force fit interengagement therebetween. Additionally, upon sufficient insertion, the cutout portion 46 of the first shell 20 will engage the portion of the eyelet 18 extending through the aperture 32, as shown most clearly in FIG. 8. As noted above, and as shown in FIG. 6, the eyelet 18 has a relatively thin side wall of dimension "j". Furthermore, as noted above, the external diameter "k" of the eyelet 18** is greater than the diameter "2*f*" of the cutout 46. As a result of these relative dimensions, continued telescoping insertion of the first shell 20 into the second shell 22 or **22*a* will cause the cutout 46 of the first shell 20 to engage and deform or crimp the eyelet 18. The depth "h" of the cutout 46 and the distance "i" of aperture 32 from the rear wall 26 of the second shell 22 permit sufficient telescoping for the crimping of eyelet 18 to occur. This deformation of the eyelet 18 will inherently result in certain original dimensions thereof being decreased, while other original dimensions thereof are increased. The decrease of dimensions of the eyelet 18 will effectively securely seal the eyelet 18 to the cable 16 and prevent relative movement therebetween. Similarly, the changes in selected dimensions of the eyelet 18 resulting from the crimping will securely engage the eyelet with the aperture 32 in the second shell 22 or the cutout 32*a* in the alternate second shell 22*a*. Thus, the eyelet 18 will be deformed or crimped to securely and sealingly engage the cable 16, and to simultaneously securely engage the shells 20 and 22 or 20 and 22*a*. As a result of this construction, movement of the cable 16 or the conductors 54 therein relative to the connector 10 is prevented. Consequently, the connector 10 achieves a right angle exit of the conductor 16 therefrom, while positively assuring the absence of strain on the conductors 54**. Additionally, this right angle strain relief connection is achieved from easily machined and relatively inexpensive components which enable a low profile to be achieved.

In summary, a connector is provided for electrical and mechanical connection to a cable. The connector enables the cable to exit at 90° to the mating axis of the connector, and achieves a well sealed strain relief connection between the cable and the connector. The connector comprises telescopingly engageable shells, one of which is provided with an aperture or cutout extending through a side wall portion thereof, while the other is provided with a longitudinally extending cutout portion at one end. A relatively thin walled eyelet is tightly slid over the cable and is urged into the aperture of the shell. The shells are then slid into telescoped relationship such that the cutout portion in one shell deforms the eyelet in proximity to the aperture or cutout in the other shell. This controlled deformation of the eyelet causes the eyelet to securely engage the cable extending therethrough and to engage the aperture of the shell through which the eyelet is directed.

While the invention has been described with respect to certain preferred embodiments, it is apparent that various changes can be made without departing from the scope of the invention as defined by the appended claims. For example, it is to be understood that the aperture and the cutout must be disposed on separate components of the shell, but the particular orientation is not material. For example, the aperture could be disposed on the front shell, while the cutout could be disposed on the rear shell. Similarly, the rear shell may telescopingly engage over or into the front shell, and may be retained in its engaged position with the front shell by either the force fit described above or other appropriate connection means. It is also to be understood that in certain embodiments and with certain cables, it may be possible to eliminate the eyelet such that the interengagement of the front and rear shells will safely but securely retain the cable to achieve the desired strain relief 90° alignment thereof.

We claim:

1. An electrical connector housing comprising: a first shell, said first shell comprising a generally tubular peripheral side wall having opposed ends, said peripheral side wall being characterized by a cutout portion extending entirely therethrough at one said end of said first shell; and a second shell having a generally tubular peripheral side wall and opposed ends, the peripheral side wall of said second shell being characterized by an aperture extending entirely therethrough at a location thereon intermediate said opposed ends, said aperture being dimensioned to receive a cable, said first and second shells being in telescoped engagement with one another, said cutout portion and said aperture being respectively disposed on said first and second shells such that a cable extending through the aperture of said second shell will be securely engaged by the cutout portion of said first shell.

2. A connector housing as in claim 1 further comprising a generally tubular eyelet, said eyelet being dimensioned to slidable receive the cable therein, and being slidably received in the aperture through the peripheral side wall of the second shell, said eyelet having a peripheral side wall with a thickness selected to enable said eyelet to be crimped by engagement of said eyelet with the cutout portion of said first shell.

3. A connector housing as in claim 2 wherein the eyelet comprises a generally cylindrical external surface and wherein the cutout portion of said first shell is generally arcuate and defines a radius less than the radius of the external cylindrical surface of the eyelet.

4. A connector housing as in claim 1 wherein the first and second shells are dimensioned to be frictionally retained in telescoped engagement.

5. A connector housing as in claim 1 wherein the second shell is dimensioned to be telescopingly engaged over at least a portion of said first shell.

6. A connector housing as in claim 5 wherein said first and second shells are generally cylindrical, and wherein the external diameter of said first shell is equal to or greater than the internal diameter of said second shell, such that the telescoping engagement of said first and second shells achieves a force fit therebetween.

7. A connector housing as in claim 6 wherein the external diameter of said first shell which equals or exceeds the internal diameter of said second shell defines a major external diameter of said first shell, and wherein said first shell further comprises a minor external diameter portion adjacent the end thereof into which the cutout portion extends, said minor external diameter portion of said first shell defining a diameter less than the internal diameter of said second shell.

8. A connector housing as in claim 1 wherein the cutout portion of said first shell defines a maximum width adjacent the associated end of said first shell and tapers to smaller widths at greater distances from said end.

9. A connector housing as in claim 8 wherein the maximum width of said cutout portion of said first shell is equal to or greater than the diameter of the aperture in said second shell.

10. An electrical connector comprising first and second shells each having generally cylindrical peripheral side walls, said first and second shells being in telescoping engagement, said first shell including a generally arcuate cutout extending through the peripheral side wall at one end of said first shell, said second shell including generally circular aperture extending through the peripheral side wall thereof at a location on said second shell intermediate the opposed ends thereof, said aperture of said second shell being generally aligned with the cutout portion of the first shell, said connector further comprising a generally cylindrical eyelet extending through the aperture in the peripheral side wall of said second shell and engaged by the cutout portion of the first shell, said connector further comprising a nonconductive insert engaged with said first shell and at least one terminal engaged with said insert, said terminal being connectable to a conductor of a cable, whereby the cable extends through said eyelet at an angle to the central axes of said cylindrical shells, and whereby the telescoping engagement of said first and second cylindrical shells causes the cutout of said first shell to crimp the eyelet such that the eyelet securely engages the cable to achieve a strain relief connection of said cable to said connector.

11. A connector as in claim 10 wherein one end of the second shell is closed.

12. A connector as in claim 10 further comprising a coupling nut rotatably mounted to said first shell at the end thereof opposite the cutout portion.

13. A connector as in claim 10 wherein the first shell is dimensioned to be telescopingly engaged within the second shell.

14. An electrical connector housing comprising a first shell having a tubular peripheral side wall and opposed forward and rear ends, said peripheral side wall being characterized by a cutout portion extending entirely therethrough at the rear end of said first shell, said cutout portion tapering to smaller dimensions at greater distances from said rear end of said first shell, a second shell comprising a generally tubular peripheral side wall and opposed forward and rear ends, said rear end of said second shell being substantially closed, said peripheral side wall of said second shell being characterized by a generally cylindrical aperture extending therethrough at generally a right angle to the longitudinal axis of said peripheral side wall, said aperture being disposed at a location intermediate the opposed ends of said second shell, said first and second shells being in telescoping engagement with one another, and a crimpable eyelet slidably inserted in the aperture in said second shell and being crimped intermediate the cutout portion of said first shell and the aperture in said second shell, whereby the crimping of the eyelet intermediate the cutout portion of said first shell and the aperture of the second shell enables said eyelet to securely retain a cable extended therethrough, such that the axis of the cable adjacent said shells is substantially at a right angle to the longitudinal axes of said shells.

15. A connector housing as in claim 14 wherein said first and second shells are generally cylindrical.

16. A connector housing as in claim 14 wherein the first shell is dimensioned to be telescopingly received within the second shell.

17. A connector housing as in claim 14 wherein the depth of said cutout portion measured from the rear end of said first shell is less than the distance between the closed rear end of said second shell and the forwardmost location on the aperture through said second shell.

18. An electrical connector housing for securely engaging an electrical cable, said housing comprising a first shell having a generally tubular peripheral side wall with opposed ends, said peripheral side wall being characterized by a first cutout means extending entirely therethrough at one said end of said first shell for securely engaging the cable; and a second shell having a generally tubular peripheral side wall and opposed ends, the peripheral side wall of said second shell being characterized by a second cutout means extending entirely therethrough at one said end of the second shell for securely engaging the cable, said first and second shells being in telescoped engagement with one another such that the cable is securely engaged by the first and second cutout means respectively of the first and second shells.

19. A connector housing as in claim 18 further comprising a generally tubular crimpable eyelet surrounding said cable and crimpingly engaged by said first and second cutout means.

20. An electrical connector housing as in claim 18 wherein said first and second shells are dimensioned to be in force fit telescoping engagement with one another.

* * * * *